United States Patent [19]

Adamson

[11] Patent Number: 4,725,313

[45] Date of Patent: Feb. 16, 1988

[54] METHOD OF EXTRACTING A PRECIOUS METAL FROM AN ORE

[76] Inventor: Earnest D. Adamson, 90 Brookwood Rd., Orinda, Calif. 94563

[21] Appl. No.: 20,139

[22] Filed: Feb. 25, 1987

Related U.S. Application Data

[63] Continuation of Ser. No. 850,484, Apr. 11, 1986, abandoned.

[51] Int. Cl.[4] ..... C22B 11/04

[52] U.S. Cl. ..... 75/118 R; 75/97 A; 75/101 R; 75/105; 75/109; 423/29; 423/31; 209/178; 209/187

[58] Field of Search ..... 423/27, 29, 30, 31; 75/109, 101 R, 105, 118 R, 97 A; 209/176, 178, 187

[56] References Cited

U.S. PATENT DOCUMENTS

| | | | |
|---|---|---|---|
| 490,193 | 1/1893 | French | 423/29 |
| 3,049,437 | 8/1962 | Rejdak | 75/109 |
| 4,289,532 | 9/1981 | Matson et al. | 423/29 |
| 4,494,986 | 1/1985 | Forsman | 75/118 R |

*Primary Examiner*—Robert L. Stoll

*Attorney, Agent, or Firm*—Robert S. Smith

[57] ABSTRACT

A method of recovering a precious metal from an ore comprises treating the ore with a cyanide solution and simultaneously treating the ore with mercury to cause amalgamation with the precious mineral.

5 Claims, 2 Drawing Figures

METHOD OF EXTRACTING A PRECIOUS METAL FROM AN ORE

This is a continuation of application Ser. No. 850,484, filed Apr. 11, 1986 now abandoned.

BACKGROUND OF THE INVENTION

This invention relates to a process for the recovery of precious metals such as gold and silver from ores containing such metals by leaching and amalgamation techniques.

Typically the recovery process consists of crushing and grinding the ore, leaching it in an alkaline cyanide solution (cyanidation), then precipitating the gold from the solution, usually by addition of zinc dust.

Where there is much free gold occurring in the ore it is usually economically advisable to use a preliminary recovery step of amalgamation, corduroy tables, or flotation. Often 40–80% of the free gold can be recovered by the preliminary step at a cost lower than that of precipitation from a cyanide solution. A further benefit is the reduction of the process time required in the cyanide solution.

The Mining Engineers' Handbook, 3rd edition, 6th printing, p. 33–11, states that grinding in a cyanide solution is customary, unless the ore (a) requires preliminary washing, or (b) undergoes preliminary amalgamation or other treatment. It further indicates that in a cyanide solution recovery by amalgamation is reduced. This would indicate that simultaneous leaching and amalgamation would not normally be considered as an efficient and productive approach.

U.S. Pat. No. 4,384,889, Wiewiorowski et al., discloses a method wherein simultaneous leaching and cementation takes place. The concept of simultaneous leaching and amalgamation is not disclosed.

Other U.S. patents showing refining processes include U.S. Pat. Nos. 4,372,830; 4,427,571; 4,431,614; and 4,483,076.

It is an object of the invention to provide a novel and efficient method of extraction of precious metals.

It is another object of the invention to provide a method which will have particular application to extraction of gold and silver.

SUMMARY OF THE INVENTION

It has now been found that these and other objects of the invention may be attained in a method of recovering a precious metal from an ore which comprises treating the ore with a cyanide solution and simultaneously treating the ore with mercury to cause amalgamation with the precious mineral.

This method in accordance with the invention may further include the step of treating with a cyanide solution includes using potassium cyanide and sodium cyanide the step of treating with a cyanide solution may include the use of sodium hydroxide and sodium carbonate the step of treating with a cyanide solution may include using a solution containing manganese dioxide, and the step of adding water, ore, mercury and a cyanide solution into a mill.

In another embodiment of the invention the amount of mercury introduced into the mill has substantially three times the weight of the precious metal in the ore.

Some embodiments of the method may include providing a plurality of inclined plates disposed at successively lower elevations at the outlet of the mill and coating the plates with potassium cyanide and mercury.

In some embodiments the method may include covering the plates with sodium hydroxide and sodium carbonate and coating the plates with a mixture of tin/lead solder and mercury.

Sometimes the plates are covered with a mixture of tin/lead solder and mercury and then the contents of the mill are discharged onto the plates.

In some forms of the invention the mercury-cyanide mixture comprises substantially four ounces of fifty-fifty tin/lead solder for each five pounds of mercury.

The material deposited on the plates may be spread with a brush prior to discharge of material from the mill onto the plates.

BRIEF DESCRIPTION OF THE DRAWINGS

The invention will be better understood by reference to the accompanying drawing in which.

DESCRIPTION OF THE PREFERRED EMBODIMENT

Figure 1:
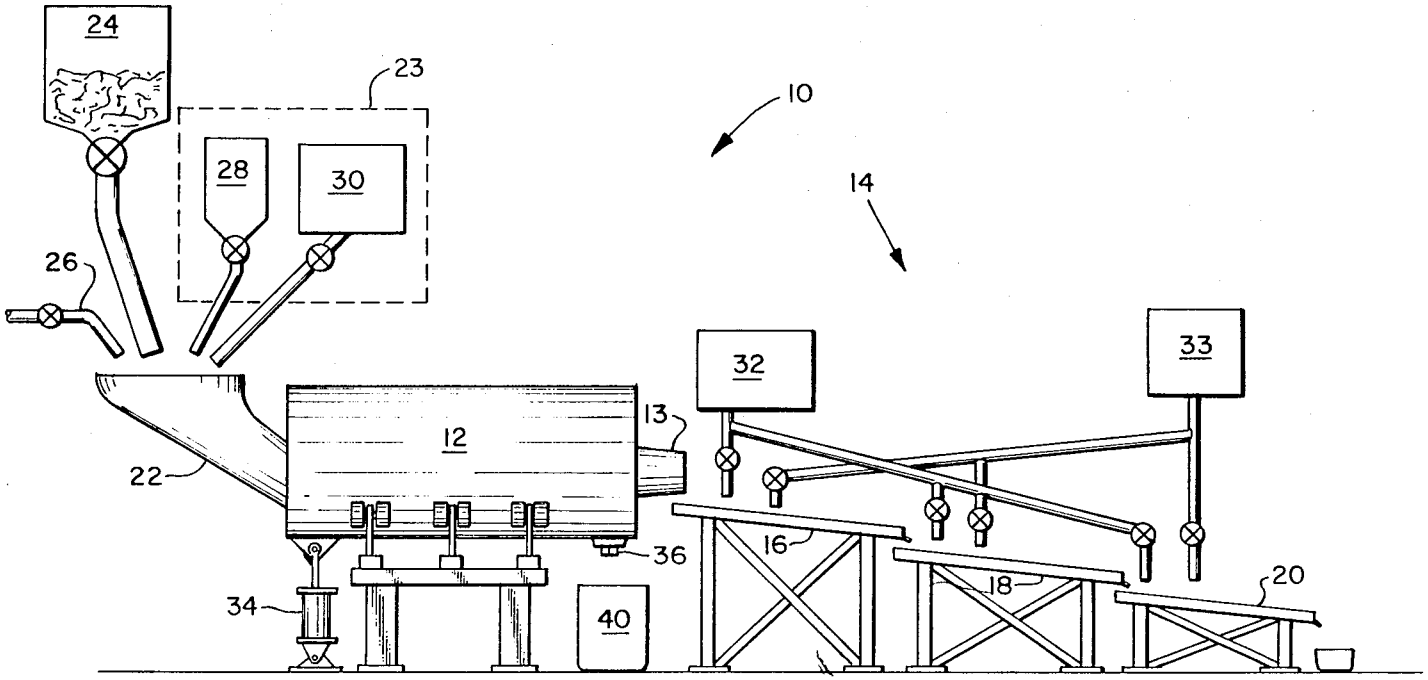
FIG. 1 is an elevation view of the apparatus used in accordance with the invention.

Referring now to FIG. 1, there is shown a precious metal recovery system 10, consisting of a grinding mill 12 and a plate system 14 comprised of plates 16, 18, 20. A mill feed tube 22 is provided, with means of introducing ore 24, water 26, and a catalyst 23 to the mill 12. The catalyst 23 is comprised of a supply of mercury 28 and a supply of a recovery solution 30. Means are also provided for supplying a second recovery solution 32 and a mercury-solder mixture 33 to the surfaces of the copper plates 16, 18, 20. A lifting device 34 and a removable plug 36 permits draining the contents of the mill 12 into a receptacle 40.

In the preferred embodiment, the recovery solutions 30 and 32 are made up of the following constituents:

Recovery solution 30:

| | |
|---|---|
| Potassium cyanide (KCN) | 9.4 oz./100 gal water |
| Sodium cyanide (NaCN) | 2.6 oz./100 gal water |
| Sodium hydroxide (NaOH) | 2.5 oz./100 gal water |
| Sodium carbonate (Na2CO3) | 25.3 oz./100 gal water |
| Manganese dioxide (MnO2) | 5.25 oz./100 gal water |
| Recovery solution 32: | |
| Potassium cyanide (KCN) | 28.0 oz./100 gal water |
| Sodium hydroxide (NaOH) | 7.0 oz./100 gal water |
| Sodium carbonate (Na2CO3) | 45 oz./100 gal water |

The mercury-solder mixture 33 is made up of 4.0 oz. of 50—50 tin/lead solder per 5 lbs. of mercury. This mixture, along with solution 32 is applied to the surface of plates 16, 18, 20, then spread with a brush to coat the surfaces evenly.

Figure 2:
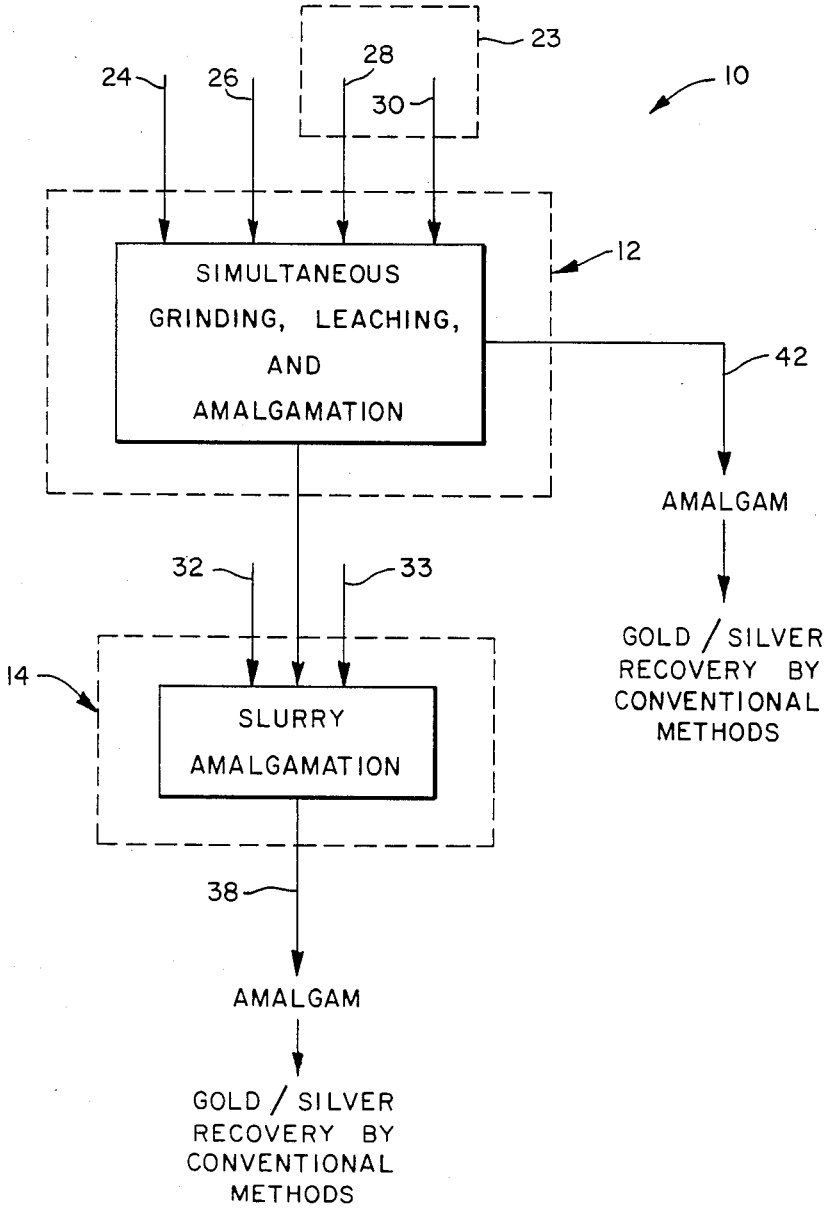
FIG. 2 is a schematic representation of one embodiment of the invention as applied to the recovery of gold.

In operation, as shown in FIG. 2, water 26, crushed ore 24, mercury 28, and solution 30 are introduced into the mill 12. The ore 24 can be ground in the mill 12 or can be ground prior to introduction into the mill 12. In any case, the desired fineness in the preferred method of the invention is 200 mesh. If the ore 24 is to be ground in the mill 12, it should be pre-crushed to pieces no larger than one inch, and sufficient grinding balls of suitable sizes should be added to assure reducing the ore to 200 mesh.

The mill 12 is charged approximately one-third full with a 50—50 mixture of ore 24 and water 26, and with an amount of mercury 28 that is approximately 3 times the amount of gold in the ore 24 as determined by assay. Solution 30 is then added to make a dilute solution. The required amount of solution 30 will vary with different ores and is determined by experimentation. The mill 12 is now run for approximately one hour to provide thorough mixing of all the materials.

At this point water is added to the mill 12 to bring the level of the mixture to a point where the slurry will spill out the mill discharge 13 and cascade over the plates 16, 18, and 20. These plates 16, 18, and 20 are each inclined and are arranged at successively lower elevations. The process becomes a continuous flow type operation when the slurry spills out the discharge 13. Input flow rates of water 26, ore 24, mercury 28, and solution 30 must be adjusted to provide proper slurry density and residence time on the plates 16, 18, 20 to achieve optimum formation of amalgam 38. These flow rates will vary depending on the nature of the ore and must be determined experimentally.

The amalgam 38 is deposited on the plates 16, 18, 20 and is periodically collected, typically at an end-of-shift shutdown. The amalgam is scraped off the plates 16, 18, and 20 and then squeezed through a chamois (not shown). Free mercury passes through the chamois and can be reclaimed and reused. Recovery of the gold or silver from the amalgam 38, which has been squeezed quite dry, is accomplished by conventional methods, preferably by retorting.

Periodically the mill 12 must be cleaned out; typically there will be one mill cleaning for every three or four plate scrapings. Cleaning of the mill 12 is accomplished by shutting off the input of materials, elevating one end of the mill 12 by the lifting means 34, removing plug 36, introducing water into the mill 12 and flushing its contents into a receptacle 40. The amalgam 42 recovered from the receptacle 40 is then treated in the same manner as the amalgam 38 taken from the plates 16, 18, 20.

ORE SAMPLE ANALYSIS

To more clearly illustrate the results obtainable from this process, two ore samples were analyzed before and after undergoing the process. Both samples were made up of tailings from a leaching plant. Sample No. 1 was from Nevada, Sample No. 2 was from South Africa.

Sample No. 1: This sample was ground to 100 mesh before being charged into the mill 12; no further grinding was done in the processing. Fifteen pounds of the concentrate were placed in the mill 12, along with 0.25 lbs of mercury 28 and 200 mg of solution 30. After adding water 26 the mill 12 was run for one hour, then discharged over the plates 16, 18, 20 over a fifteen minute period. Assay values, in ounces per ton of concentrate, for gold and silver were:

| | Silver | Gold |
|---|---|---|
| Before processing | 7.94 | .95 |
| After processing | .83 | .20 |

Sample No. 2: 17 pounds of this sample, ground to 200 mesh, together with 0.50 lbs of mercury 28, and 300 mg of solution 30 were charged into the mill 12. After adding water 26, the mill was run for one hour. The slurry was discharged over the plates 16, 18, 20 over a 30 minute time period. Assay values in ounces per ton of concentrate were:

| | Gold | Silver |
|---|---|---|
| Before processing | 1.58 | .01 |
| After processing | .89 | .17 |

The invention described above provides for an improved process which permits simultaneous grinding, leaching and amalgamation, without the need for preliminary washing or cleaning to remove impurities or carbonaceous material that might hinder the recovery process.

The invention has been described with reference to its illustrated preferred embodiment. Persons skilled in the art of precious metal mining may upon exposure to the teachings herein, conceive other variations. Such variations are deemed to be encompassed by the disclosure, the invention being delimited only by the appended claims.

Having thus described my invention I claim:

1. A method of recovering a precious metal from an ore which comprises:
   the step of adding ore into a mill;
   treating the ore in the mill with a solution which includes water, potassium cyanide, sodium cyanide, sodium hydroxide, manganese dioxide, and sodium carbonate and simultaneously introducing mercury into contact with the ore inside the mill to cause amalgamation with the precious metal, the amount of mercury introduced into said mill being substantially three times the weight of the precious metal in the ore, the combination inside the mill being a slurry; and
   operating the mill for approximately one hour and then discharging the slurry from the mill.

2. The method as described in claim 1, further including:
   providing a plurality of inclined plates disposed at successively lower elevations at the outlet of the mill and coating the plates with a mixture of sodium hydroxide, sodium carbonate, potassium cyanide and a mixture of a tin and lead solder together with mercury before discharging the slurry from the mill onto the plates.

3. The method as described in claim 2 wherein:
   the step of coating the plates with a mixture of tin and lead solder includes the use of mixture comprising substantially four ounces of fifty-fifty tin and lead solder for each five pounds of mercury.

4. The method as described in claim 3, wherein:
   the material deposited on the plates is spread with a brush prior to discharge the slurry from the mill onto the plates.

5. The method as described in claim 1, wherein:
   the ratio of ore to water in the mill is approximately 50—50 by weight.

* * * * *